US007097171B2

(12) United States Patent
Kang

(10) Patent No.: US 7,097,171 B2
(45) Date of Patent: Aug. 29, 2006

(54) PAPER FEEDING APPARATUS HAVING AN ACTIVE PAPER SEPARATING UNIT IN AN IMAGE FORMING APPARATUS

(75) Inventor: Hoon Kang, Gyunggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 207 days.

(21) Appl. No.: 10/750,895

(22) Filed: Jan. 5, 2004

(65) Prior Publication Data

US 2004/0150153 A1 Aug. 5, 2004

(30) Foreign Application Priority Data

Feb. 5, 2003 (KR) ..... 10-2003-0007278

(51) Int. Cl.
*B65H 3/46* (2006.01)

(52) U.S. Cl. ..... 271/122; 271/121; 271/167

(58) Field of Classification Search ..... 271/121, 271/122, 167, 162
See application file for complete search history.

(56) References Cited

U.S. PATENT DOCUMENTS 4,575,068 A * 3/1986 Kato ..... 271/122
5,431,385 A * 7/1995 Holbrook ..... 271/122
5,927,706 A * 7/1999 Hiroi et al. ..... 271/117

* cited by examiner

*Primary Examiner*—Eileen D. Lillis
*Assistant Examiner*—Kaitlin Joerger

(74) *Attorney, Agent, or Firm*—Staas & Halsey LLP

(57) ABSTRACT

A paper feeding apparatus includes: a frame forming one of a paper stacker and a paper feed tray on which paper is stackable; a paper feed unit disposed above the frame and including a pickup roller which picks up the paper; and an active paper separator disposed at a lower part of the frame in the paper feeding direction thereof, contacting leading ends of sheets disposed in the frame, rotatable in an anti-paper feeding direction opposite the feeding direction so as to actively rub the leading ends and thereby separate and feed the sheets one at a time when the sheets of paper are picked up by the pickup roller.

24 Claims, 4 Drawing Sheets

PAPER FEEDING APPARATUS HAVING AN ACTIVE PAPER SEPARATING UNIT IN AN IMAGE FORMING APPARATUS

CROSS-REFERENCE TO RELATED APPLICATIONS

This application claims the benefit of Korean Application No. 2003-07278, filed Feb. 5, 2003, in the Korean Intellectual Property Office, the disclosure of which is incorporated herein by reference.

BACKGROUND OF THE INVENTION

1. Field of the Invention

The present invention relates to a paper feeding apparatus of an image forming apparatus, such as an office machine such as a copier, a printer and a fax, and more particularly, to a paper feeding apparatus of an image forming apparatus having an active paper separating unit, which is disposed at a lower part in the paper feeding direction of a stacker or a cassette for stacking paper to rotate in the anti-paper feeding direction and to actively rub leading ends of sheets of paper, thereby separating and feeding the sheets of paper sheet by sheet.

2. Description of the Related Art

An image forming apparatus, such as an office machine, such as a printer and a fax, generally comprises a paper feeding apparatus feeding sheets of paper to an image forming unit.

As shown in FIG. 1, such paper feeding apparatus 10 comprises a frame 11 composing a stacker or a cassette for stacking paper, a pickup unit 30 disposed at the lower side in the paper feeding direction (right hand side of FIG. 1) of the frame 11 to rotate in association with a power transferring gear train (not shown) connected with a pickup roller driving motor (not shown) and to pick up sheets of paper stacked in the frame 11, and a paper separating assembly 40 comprising a plurality of paper separating plates integrally or separately disposed to the frame 11 at the lower side in the paper feeding direction of the frame 11 to separate and feed a sheet of paper at a time while supporting the sheet of paper to enter at a predetermined angle.

The pickup unit 30 comprises a pickup roller assembly 33 comprising a pickup shaft 31 connected to the power transferring gear train, a first gear (not shown) formed around the pickup shaft 31, a first and a second idle gears (not shown) pivotably disposed around a first and a second idle shafts 37, 38 to move in association with the first gear, a pickup roller gear (not shown) connected to the second idle gear, a pickup roller 34 coaxially formed with the pickup roller gear to pick up a sheet of paper, an unidirectional power transfer unit (not shown) such as a spring clutch for transferring rotary power only in the paper pickup direction to the pickup roller gear between the pickup roller gear and the second idle gear, and a link member 36 with one end connected with a pickup roller shaft 39 and the other end pivotably supported on a supporting shaft 35 to support the pickup roller 34 to be in contact with paper.

Hereinafter, the operation of a conventional paper feeding apparatus 10 having the above described structure will be described.

When a paper feed mode is selected, the pickup shaft 31 rotates in the pickup direction, for example, clockwise, by the power transferring gear train connected to the pickup roller driving motor, and accordingly the pickup roller 34 rotates counterclockwise in association with the first gear, the first and second idle gears and the pickup roller gear.

As a result, a sheet of paper in contact with the pickup roller 34 is picked up and fed as the pickup roller 34 rotates counterclockwise.

The paper picked up by the pickup roller 34 is separated sheet by sheet while being supported to be in a predetermined paper-entering angle by the paper separating plates of the paper separating assembly 40 and then conveyed to the image forming unit (not shown).

After that, when the paper activates a paper sensor (not shown), a control unit (not shown) stops the pickup roller driving motor and starts a paper feed roller driving motor (not shown), or transfers the driving force of the pickup roller driving motor to the paper feed roller driving unit (not shown) thereby driving a paper feed roller conveying paper through a power connection/blocking device such as a swing gear (not shown) in order to stop the pickup roller 34 and drive the paper feed roller (not shown).

As a result, the paper is continuously conveyed to the image forming unit by the paper feed roller. The pickup roller 34 receiving counterclockwise rotary force from the paper idle-rotates without transferring rotary force to the pickup roller gear due to the unidirectional power transfer unit of the pickup roller assembly 33.

However, in such conventional paper feeding apparatus 10, a picking up or feeding force of the pickup roller 34 is determined on the basis of a weight of the paper which is commonly used. Accordingly, when sheets of paper which are rarely used are picked up or fed, the paper feeding force is not suitable for such sheets, so that a sheet pickup problem such as a multi sheet feed or a sheet feed failure may occur during paper pickup.

More specifically, currently used papers have various weights ranging from 40 g/m$^2$ to 200 g/m$^2$, but a paper feeding force of the pickup roller 34 is determined on the basis of the paper having a weight ranging from 60 g/m$^2$ to 90 g/m$^2$ which is commonly used. Accordingly, when sheets of paper having a weight of below 60 g/m$^2$ or above 90 g/m$^2$ are picked up, the sheet pickup problem may occur.

To solve such a sheet pickup problem generating when various sheets of paper are fed by one paper feeding force determined as explained as above, the conventional paper feeding apparatus 10 is generally provided with paper separating plates having a paper-entering angle determined to separate and feed sheets of paper sheet by sheet without generating the sheet pickup problem to sheets of paper having a weight of below 60 g/m$^2$ or above 90 g/m$^2$.

However, even though the paper-entering angle of the paper separating plates is determined not to generate the sheet pickup problem to the sheets of paper which are rarely used, if a thickness of and a frictional force between sheets vary as a kind of paper, the paper-entering angle determined like that comes not to tally with that which is required of the sheets to be practically fed by the paper feeding apparatus 10.

Thus, if the paper-entering angle is not tallied (i.e., considered) with the practically required paper-entering angle, the paper feeding apparatus 10 comes to again present the sheet pickup problem such as the multi sheet feed or the sheet feed failure.

To solve this problem, a method of forming the paper separating plates from material having relatively large frictional force such as a rubber, or a method of forming projections on the paper separating plates can be considered. However, these methods have a disadvantage that since the paper separating plates is fixedly disposed, they cannot directly or actively give a frictional force on the sheets, if a paper-entering angle thereof which is required of the sheets to be practically fed does not tally with a paper-entering angle thereof, and thereby there is a limit to what ranges the sheet pickup problem is prevented from occurring.

SUMMARY OF THE INVENTION

The invention has been developed to solve the above and/or other problems and disadvantages and to provide at least the advantages described hereinafter.

Accordingly, one aspect of the present invention is to solve the foregoing and/or other problems by providing an improved paper feeding apparatus of an image forming apparatus having an active paper separating unit, which is disposed at a lower part in the paper feeding direction of the frame contacting leading ends of sheets of paper to rotate in the anti-paper feeding direction and to actively rub the leading ends of the sheets, thereby to prevent a sheet pickup problem such as multi sheet feed or a sheet feed failure from occurring during paper pickup.

Additional aspects and/or advantages of the invention will be set forth in part in the description which follows and, in part, will be obvious from the description, or may be learned by practice of the invention.

According to an aspect of the present invention, there is provided a paper feeding apparatus including: a frame forming one of a paper stacker and a paper feed tray on which paper is stackable; a paper feed unit disposed above the frame and including a pickup roller which picks up the paper; and an active paper separator disposed at a lower part of the frame in the paper feeding direction thereof, contacting leading ends of sheets disposed in the frame, rotatable in an anti-paper feeding direction opposite the feeding direction so as to actively rub the leading ends and thereby separate and feed the sheets one at a time when the sheets of paper are picked up by the pickup roller.

The active paper separator may include: a friction part disposed at the lower part in the paper feeding direction and rotatable while supporting the leading ends so that the sheets enter at a paper-entering angle; and a driving part which rotates the friction part in association with a driving source which drives the paper feed unit.

The friction part may include: a friction belt rotatably disposed at an angle; and first and second belt pulleys rotatably respectively supporting ends of the friction belt at the lower part in the paper feeding direction. The friction belt may be formed of a rubber material.

The friction part further may include a friction adjusting member which adjusts a tension of the friction belt so as to always yield a frictional force to the leading ends. The friction adjusting member may include: a tension adjusting roller disposed in contact with the friction belt; and a tension adjusting roller supporting axle rotatably supporting the tension adjusting roller at the lower part in the paper feeding direction.

The driving part may include: a driving gear disposed so that at least a part thereof projects one of outwardly and upwardly from the lower part in the paper feeding direction and connected to the driving source which drives the paper feed unit via a gear train; and a driving axle coaxially connecting the driving gear and one of the first and the second belt pulleys.

The apparatus may further comprise at least one paper separating plate fixedly disposed at the angle at the lower part in the paper feeding direction which separates and feeds the sheets of paper one at a time while supporting the leading ends of the sheets stacked in the frame so that the sheets enter at the paper-entering angle in association with the friction part, when the sheets of paper are picked up by the pickup roller.

The active paper separator may include: a friction part rotatably disposed at the lower part in the paper feeding direction so that at least one tangent line thereof intersects the leading ends of the sheets, in order to separate and feed the sheets one at a time; and a driving part which rotates the friction part in association with a driving source which drives the paper feed unit.

The friction part may include at least one rotating roller rotatably disposed and the rotating roller may be formed of rubber.

The driving part may include: a driving gear disposed so that at least a part thereof projects one of outwardly and upwardly from the lower part in the paper feeding direction and connected to the driving source which drives the paper feed unit via a gear train; and a driving axle coaxially connecting the driving gear and the rotating roller.

The apparatus may further comprise at least one paper separating plate fixedly disposed at the angle at the lower part in the paper feeding direction which separates and feeds the sheets of paper one at a time while supporting the leading ends of the sheets stacked in the frame so that the sheets enter at the paper-entering angle in association with the friction part, when the sheets of paper are picked up by the pickup roller.

The friction part includes a plurality of rotating rollers rotatably disposed and having a common tangent line inclined at an angle so as to intersect the leading ends of the sheets, and a plurality of rotating roller supporting axles respectively supporting the plurality of rotating rollers. The driving part may include a driving gear having at least a part thereof projecting one of outwardly and upwardly from the lower part in the paper feeding direction so as to connect with the driving source which drives the paper feed unit via a gear train, a driving axle one of forming the plurality of rotating roller supporting axles and coaxially connecting the driving gear and one of the plurality of the rotating rollers, a plurality of rotating roller gears coaxially formed on the respective rotating roller supporting axles, and a plurality of idle gears disposed between the rotating roller gears.

According to still another aspect of the present invention, there is provided an image forming apparatus machine including: an image former; and a paper feeder having a frame forming one of a paper stacker and a paper feed tray on which paper is stackable, a paper feed unit disposed above the frame and including a pickup roller which picks up paper, and an active paper separator disposed at a lower part of the frame in the paper feeding direction thereof, contacting leading ends of sheets disposed in the frame, rotatable in an anti-paper feeding direction opposite the feeding direction so as to actively rub the leading ends and thereby separate and feed the sheets one at a time when the sheets of paper are picked up by the pickup roller.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF EMBODIMENTS

Figure 1:
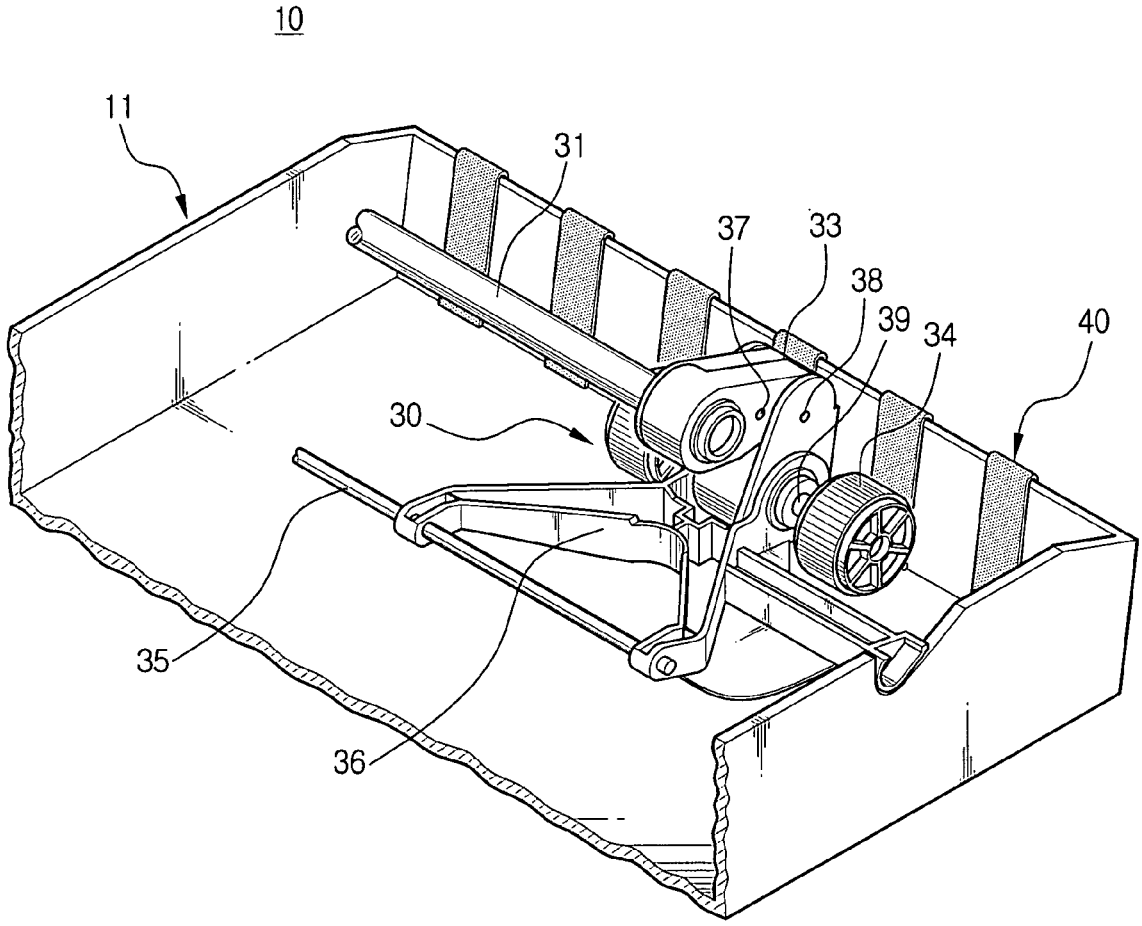
FIG. 1 (PRIOR ART)
FIG. 1 is a partial perspective view of a conventional paper feeding apparatus.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
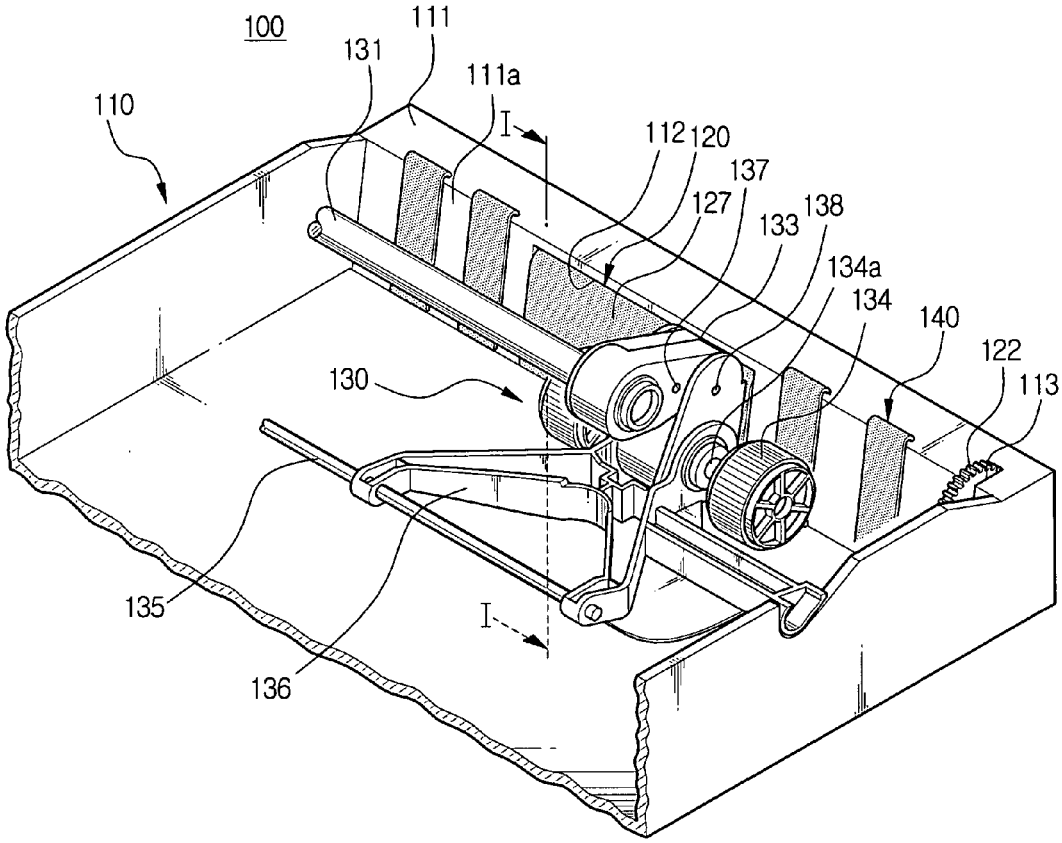
FIG. 2 is a partial perspective view of a paper feeding apparatus of an image forming apparatus having an active paper separating unit according to a first embodiment of the present invention.

In FIG. 2, a paper feeding apparatus 100 of an image forming apparatus having an active paper separating unit according to an embodiment of the present invention is illustrated.

As the paper feeding apparatus 10 shown in FIG. 1, the paper feeding apparatus 100 according to an embodiment comprises a frame 110 comprising a stacker or a tray for stacking paper, and a pickup unit 130 disposed at a lower part 111 in the paper feed direction (right hand side of FIG. 2) of the frame 110 to rotate in association with a power transferring gear train (not shown) connected with a pickup roller driving motor (not shown) driving a pickup roller 134 of the pickup unit 130 and to pick up sheets of paper stacked in the frame 110. The pickup roller 134 rotates about a pickup roller shaft 134*a*.

Similar to the pickup unit 30 shown in FIG. 1, the pickup unit 130 comprises a pickup roller assembly 133 comprising a pickup shaft 131 connected to the power transferring gear train, a first gear (not shown) formed around the pickup shaft 131, a first and a second idle gears (not shown) pivotably disposed around a first and a second idle shafts 137, 138 to move in association with the first gear, a pickup roller gear (not shown) connected to the second idle gear, a pickup roller 134 coaxially formed with the pickup roller gear to pick up a sheet of paper, an unidirectional power transfer unit (not shown) such as a spring clutch for transferring rotary power only in the paper pickup direction to the pickup roller gear between the pickup roller gear and the second idle gear, and a link member 136 with one end connected with a pickup roller shaft 134*a* and the other end pivotably supported on a supporting shaft 135 to support the pickup roller 134 to be in contact with paper.

At the lower part 111 in the paper feed direction of the frame 110 contacting leading ends of the sheets of paper an active paper separating unit 120 is disposed to rotate in the anti-paper feeding direction and to actively rub the leading ends of the sheets, thereby to separate and feed a sheet of paper at a time when the sheets of paper are picked up by the pickup roller 134.

Figure 3:
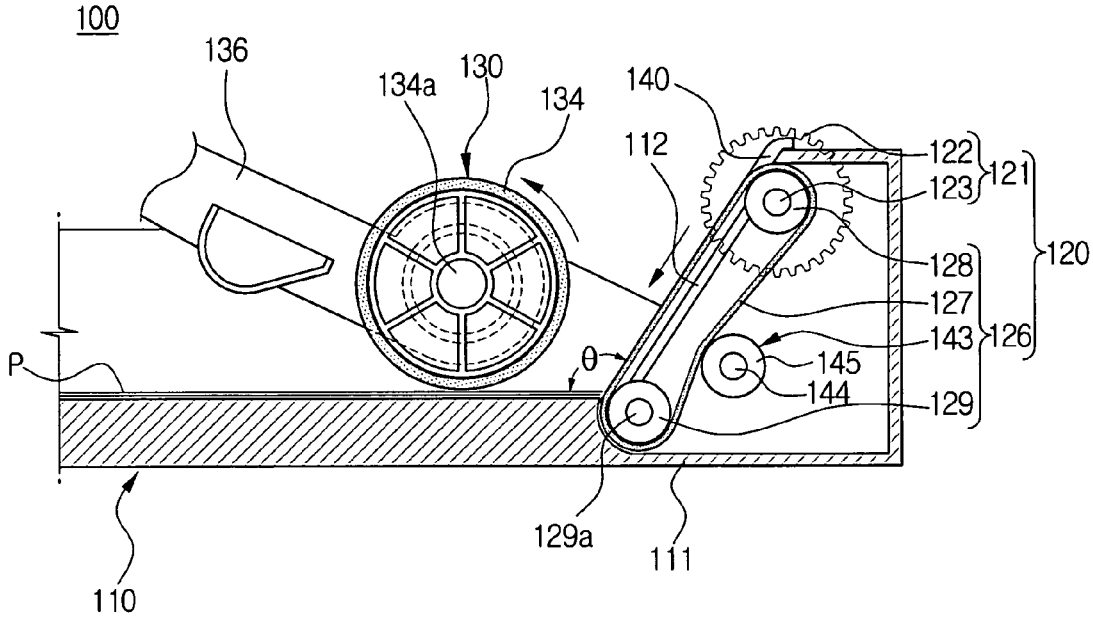
FIG. 3 is a side sectional view of the paper feeding apparatus of the image forming apparatus of FIG. 2 taken along line I—I.

As shown in FIG. 3, the active paper separating unit 120 comprises a friction part 126 disposed in a friction part receiving opening 112 formed at an inclined surface 111*a* of at the lower part 111 in the paper feeding direction of the frame 110, to be rotatable while supporting the leading ends of the sheets to enter at a paper-entering angle, in order to separate and feed a sheet of paper at a time, and a driving part 121 disposed in a driving part receiving opening 113 (shown in FIG. 2) formed at one side of the lower part 111 in the paper feed direction of the frame 110, to rotate the friction part 126 in association with the pickup roller driving motor for driving the pickup roller 134 of the pickup unit 130. The friction part 126 is disposed at an angle E similar or equal to the paper-entering angle.

The friction part 126 includes a friction belt 127 rotatably disposed at the angle θ, and a first and a second belt pulleys 128 and 129, respectively, having a width wider than that of the friction belt 127 to rotatably support both ends of the friction belt 127 at the lower part 111 in the paper feeding direction of the frame 110.

The friction belt 127 is disposed to be inclined at the angle θ but is swingable at the upward and downward directions within a certain range due to its own droop characteristic when it is rotated by the first pulley 128 and an elongated driving axle 123 of the driving part 121 to be described later.

The friction belt 127 is formed of rubber material to easily generate a friction against the leading ends of the sheets.

The first and the second belt pulleys 128 and 129, respectively, are rotatably supported on the elongated driving axle 123 of the driving part 121, and a second belt pulley supporting axle 129*a* having a length longer than the width of the friction belt 127, respectively. The driving axle 123 and the second belt pulley supporting axle 129*a* are supported at a support (not shown) of the lower part 111 in the paper feeding direction of the frame 110.

Also, the friction part 126 also includes a friction adjusting member 143 adjusting a tension of the friction belt 127 to always give a frictional force to the leading ends of the sheets. The friction adjusting member 143 comprises a tension adjusting roller 145 disposed to be in contact with the friction belt 127 at a pressure and a tension adjusting roller supporting axle 144 rotatably supporting the tension adjusting roller 145 at the lower part 111 in the paper feeding direction of the frame 110. The tension adjusting roller supporting axle 144 has a length longer than the width of the friction belt 127.

The driving part 121 is provided with a driving gear 122 having at least a part thereof disposed to project outwardly or upwardly from the driving part receiving opening 113 of the lower part 111 in the paper feeding direction of the frame 110, thereby to connect with the pickup roller driving motor for driving the pickup roller 134 of the pickup unit 130 through the power transmitting gear train when the frame 110 is mounted in a main body of the image forming apparatus, and the elongated driving axle 123 coaxially connecting between the driving gear 122 and the first belt pulley 128.

Here, it should be noted that the driving gear 122 is explained as driven by the pickup roller motor for driving the pickup roller 134 of the pickup unit 130, but the present invention is not limited to this, and it may also be driven by any other motor, for example, a motor driving a paper feed roller (not shown), or both the paper feed roller and the pickup roller 134.

In the present embodiment, at the inclined surface 111*a* of the lower part 111 in the paper feeding direction of the frame 110 is additionally installed a paper separating assembly 140 having four paper separating plates disposed to be inclined at the angle θ.

The paper separating assembly 140 functions to separate and feed a sheet of paper at a time while supporting the leading ends of the sheets stacked in the frame 110 to enter at the paper-entering angle in association with the friction belt 127 of the friction part 126, when the sheets of paper are picked up by the pickup roller 134.

The operation of the paper feeding apparatus 100 of the image forming apparatus having the active paper separating unit 120 according to the present embodiment having the above described structure will be explained in detail with reference to FIGS. 2 and 3.

First, according to a print command, when the pickup roller driving motor driving the pickup roller 134 of the pickup unit 130 is driven to rotate the pickup roller 134 at one direction, for example, counterclockwise, in the same manner as the paper feeding apparatus 10 shown in FIG. 1, the driving gear 122 is rotated counterclockwise by the gear train to rotate the first belt pulley 128 coaxially connected therewith through the driving axle 123, counterclockwise.

As the first belt pulley 128 rotates counterclockwise, the second belt pulley 129 also rotates counterclockwise in association with the first belt pulley 128 through the friction belt 127.

Figure 5:
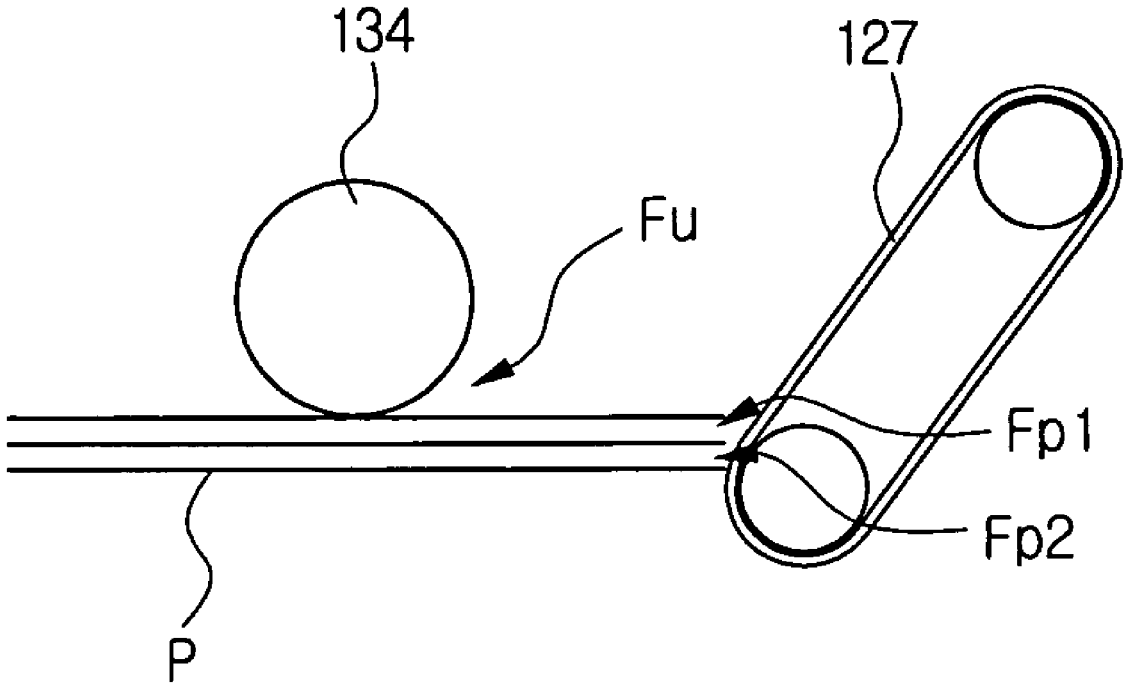
FIG. 5 is a schematic view illustrating the operation of the paper feeding apparatus of the image forming apparatus shown in FIG. 2.

Accordingly, as shown in FIG. 5, the leading ends of the sheets of paper P, which are picked up in the paper feed direction, i.e., right hand side of the drawing by a rotary friction force Fu of the pickup roller 134 while being supported to enter at the paper-entering angle along the paper separating plates of the paper separating assembly 140, come to receive a rotary friction force of the friction belt 127 which rotates counterclockwise and swings in the upward and downward directions within the certain range.

At this point, even though a frictional force Fp1 between an uppermost paper and a next-uppermost paper is larger than a frictional force Fp2 between the next-uppermost paper and a further next-uppermost paper, thereby to pick up the uppermost paper together with the next-uppermost paper, it is offset by the rotary friction force of the friction belt 127 which rotates counterclockwise swinging at the upward and downward directions within the certain range. Therefore, the uppermost paper is not picked up together with the next-uppermost paper.

The uppermost paper picked up by the pickup roller 134 as described above is conveyed to the image forming unit by the paper feed roller in the same manner as the paper feeding apparatus 10 shown in FIG. 1.

Figure 4:
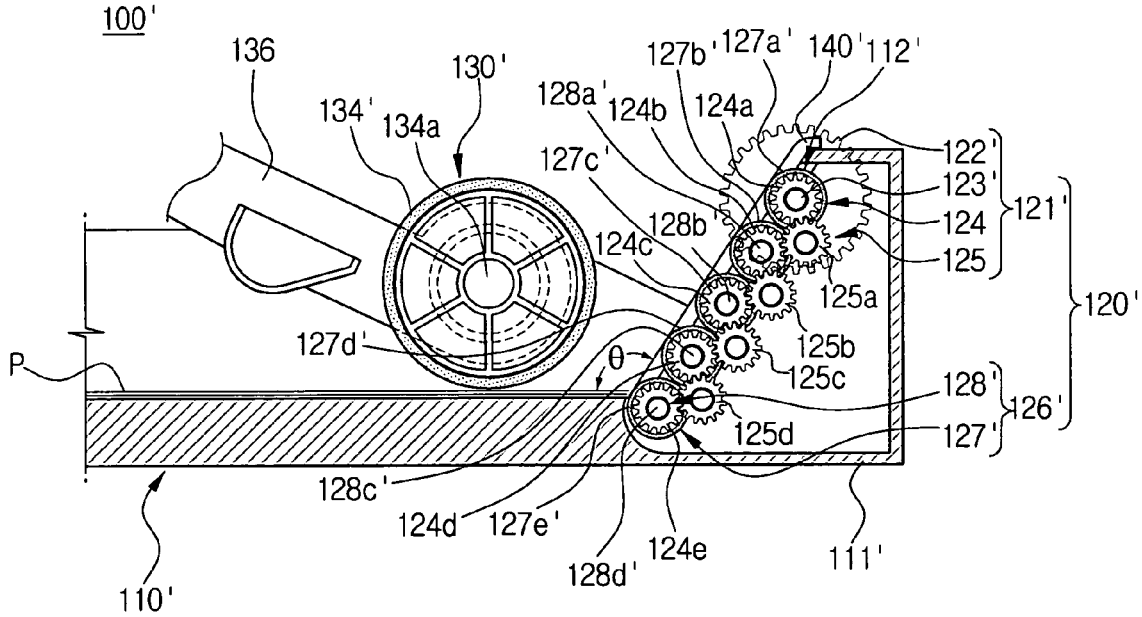
FIG. 4 is a side sectional view of a paper feeding apparatus of an image forming apparatus having an active paper separating unit according to a second embodiment of the present invention.

FIG. 4 shows a paper feeding apparatus 100' of an image forming apparatus having an active paper separating unit 120' according to another embodiment of the present invention.

The construction of the paper feeding apparatus 100' is identical to that of the paper feeding apparatus 100 shown in FIGS. 2 and 3, except that a friction part 126' of the active paper separating unit 120' is constructed to have a rotation roller member 127' and a driving part 121' is constructed to drive the rotation roller member 127'.

That is, the active paper separating unit 120' comprises a friction part 126' rotatably disposed at a lower part 111' in the paper feeding direction of a frame 110' to allow at least one tangent line thereof to be in contact with leading ends of sheets of paper, in order to separate and feed a sheet of paper at a time, and a driving part 121' disposed to rotate the friction part 126' in association with a driving motor driving a pickup roller 134' of a pickup unit 130' and/or a paper feed roller (not shown) conveying paper. The pickup roller 134' rotates about a pickup roller shaft 134*a*.

The friction part 126' is provided with a rotating roller assembly 127' rotatably disposed in a friction part receiving opening 112' of at the lower part 111' in the paper feeding direction of the frame 110', and a rotating roller supporting axle member 128' supporting the rotating roller assembly 127'.

The rotating roller assembly 127' comprises a first, a second, a third, a fourth, and a fifth rotating rollers 127*a*', 127*b*', 127*c*', 127*d*', 127*e*', respectively. The first, the second, the third, the fourth, and the fifth rotating rollers 127*a*', 127*b*', 127*c*', 127*d*', 127*e*' are disposed to have a common tangent line inclined at an angle θ' to be in contact with the leading ends of the sheets.

Each of the first, the second, the third, the fourth, and the fifth rotating rollers 127*a*', 127*b*', 127*c*', 127*d*', 127*e*' is formed to slightly swing regularly or irregularly within a certain range beyond paper separating plates of a paper separating assembly 140' to be described later to give a frictional force to the leading ends of the sheets picked up by the pickup roller 134'. For this, each of the first, the second, the third, the fourth, and the fifth rotating rollers 127*a*', 127*b*', 127*c*', 127*d*', 127*e*' has fine projections formed on surfaces thereof.

Each of the first, the second, the third, the fourth, and the fifth rotating rollers 127*a*', 127*b*', 127*c*', 127*d*', 127*e*' is formed of rubber material to easily generate a friction against the leading ends of the sheets.

The rotating roller supporting axle member 128' comprises a first, a second, a third, a fourth, and a fifth rotating roller supporting axles 123', 128*a*', 128*b*', 128*c*', 128*d*', respectively, supporting the first, the second, the third, the fourth, and the fifth rotating rollers 127*a*', 127*b*', 127*c*', 127*d*', 127*e*', respectively.

The first rotating roller supporting axle 123' among the rotating roller supporting axles 123', 128*a*', 128*b*', 128*c*', 128*d*' forms a driving axle of the driving part 121' which will be described below.

The driving part 121' comprises a driving gear 122' having at least a part thereof disposed to project outwardly or upwardly from a driving part receiving opening (not shown) formed at one side of the lower part 111' in the paper feeding direction of the frame 110', thereby to connect with the driving motor driving the pickup roller 134' of the pickup unit 130' or the paper feed roller through a power transmitting gear train when the frame 110' is mounted in a main body of the image forming apparatus, an elongated driving axle forming the first rotating roller supporting axle 123' of the friction part 126' and coaxially connecting between the driving gear 122' and the first rotating roller 127*a*', a rotating roller gear member 124 coaxially formed on the rotating roller supporting axle member 128', and an idle gear member 125 disposed with respect to the rotating roller gear member 124 to control the rotation direction of the rotating roller gear member 124.

The rotating roller gear member 124 comprises a first, a second, a third, a fourth, and a fifth rotating roller gears 124*a*, 124*b*, 124*c*, 124*d*, 124*e*, respectively, coaxially formed on the first, the second, the third, the fourth, and the fifth rotating roller supporting axles 123', 128*a*', 128*b*', 128*c*', 128*d*', respectively, whereas the idle gear member 125 comprises a first, a second, a third, and a fourth idle gears 125*a*, 125*b*, 125*c*, 125*d* disposed between the first, the second, the third, the fourth, and the fifth rotating roller gears 124*a*, 124*b*, 124*c*, 124*d*, 124*e*. The first, the second, the third, and the fourth idle gears 125*a*, 125*b*, 125*c*, 125*d* assure the rotation directions of the rotating roller gears 124*b*, 124*c*, 124*d*, 124*e* to tally with each other.

Also, at an inclined surface (not shown) of the lower part 111' of the frame 110' and in the paper feeding direction is a paper separating assembly 140'. The paper separating assembly 140' has four paper separating plates inclined at the angle θ' and is spaced from the pickup unit 130'.

The paper separating assembly 140' functions to separate and feed a sheet of paper at a time while supporting the leading ends of the sheets stacked in the frame 110' to enter at a paper-entering angle in association with the rotating roller member 127' of the friction part 126', when the sheets of paper are picked up by the pickup roller 134'.

The operation of the paper feeding apparatus 100' of the image forming apparatus having the active paper separating unit 120' according to the modified example of the present invention having the above described structure will be explained in great details with reference to FIG. 4.

First, according to a print command, when the motor driving the pickup roller 134' of the pickup unit 130' and/or the paper feed roller is driven to rotate the pickup roller 134' at one direction, for example, counterclockwise, in the same manner as the paper feeding apparatus 10 shown in FIG. 1, the driving gear 122' is rotated counterclockwise by the gear train to rotate the first rotating roller 127*a*' coaxially connected therewith through the first rotating roller supporting axle, i.e., the driving axle 123', counterclockwise.

As the first rotating roller 127*a*' rotates counterclockwise, the second rotating roller 127*b*' also rotates counterclockwise in association with the first rotating roller 127*a*' through the first and the second rotating roller gears 124*a*, 124*b* and the first idle gear 125*a*.

In the same manner as described above, the third, the fourth and the fifth rotating rollers 127*c*', 127*d*' and 127*e*' rotate in turn counterclockwise through the second, the third, the fourth and the fifth rotating roller gear 124*b*, 124*c*, 124*d*, 124*e* and the second, the third and the fourth idle gear 125*b*, 125*c*, 125*b*, respectively.

Accordingly, the leading ends of sheets of paper P, which are picked up in the paper feed direction, i.e., right hand side of the drawing by a rotary friction force Fu of the pickup roller 134' while being supported to enter at the paper-entering angle along the paper separating plates of the paper separating assembly 140', come to receive a rotary friction force of the first, the second, the third, the fourth, and the fifth rotating rollers 127*a*', 127*b*', 127*c*', 127*d*', 127*e*' which rotate counterclockwise and swing slightly within the certain range beyond the paper separating plates.

At this point, even though a frictional force Fp1 between an uppermost paper and a next-uppermost paper is larger than a frictional force Fp2 between the next-uppermost paper and a further next-uppermost paper thereby to pick up the uppermost paper together with the next-uppermost paper, it is offset by the rotary friction force of the first, the second, the third, the fourth, and the fifth rotating rollers 127*a*', 127*b*', 127*c*', 127*d*', 127*e*' which rotate counterclockwise and swing slightly within the certain range. Therefore, the uppermost paper is not picked up together with the next-uppermost paper.

After that, the uppermost paper picked up by the pickup roller 134' is conveyed to the image forming unit by the paper feed roller in the same manner as the paper feeding apparatus 10 shown in FIG. 1.

The paper feeding apparatus of the above-described embodiments of the present invention prevents a sheet pickup problem such as multi sheet feed or a sheet feed failure from occurring during paper pickup, by having the active paper separating unit disposed at the lower part in the paper feeding direction of the frame contacting the leading ends of the sheets to rotate in the anti-paper feeding direction and to actively rub the leading ends of the sheets.

Although a few embodiments of the present invention have been shown and described, the present invention is not limited to the above-described embodiments. Rather, it would be appreciated by those skilled in the art that changes may be made in these embodiments without departing from the principles and spirit of the invention, the scope of which is defined by the claims and their equivalents.

What is claimed is:

1. A paper feeding apparatus comprising:

a frame forming one of a paper stacker and a paper feed tray on which paper is stackable;

a paper feed unit disposed above the frame and including a pickup roller which picks up the paper; and an active paper separator disposed at a lower part of the frame in the paper feeding direction thereof, contacting leading ends of sheets disposed in the frame, at a certain angle, rotatable in an anti-paper feeding direction opposite the feeding direction so as to actively rub the leading ends and thereby separate and feed the sheets one at a time when the sheets of paper are picked up by the pickup roller, wherein the active paper separator includes:

a friction part disposed at the lower part in the paper feeding direction and rotatable while supporting the leading ends so that the sheets enter at a paper-entering angle; and a driving part which rotates the friction part in association with a driving source which drives the paper feed unit and includes a driving gear disposed so that at least a part thereof projects one of outwardly and upwardly from the lower part in the paper feeding direction and connected to the driving source which drives the paper feed unit via a gear train.

2. The apparatus of claim 1, wherein the friction part includes:

a friction belt rotatably disposed at an angle; and first and second belt pulleys rotatably respectively supporting ends of the friction belt at the lower part in the paper feeding direction.

3. The apparatus of claim 2, wherein the friction part includes:

a friction adjusting member which adjusts a tension of the friction belt so as to always yield a frictional force to the leading ends, and wherein the friction adjusting member includes:

a tension adjusting roller disposed in contact with the friction belt; and a tension adjusting roller supporting axle rotatably supporting the tension adjusting roller at the lower part in the paper feeding direction.

4. The apparatus of claim 2, wherein the first and second belt pulleys are spaced by a distance greater than a length of the friction belt.

5. The apparatus of claim 2, wherein the friction belt is swingable between a first and a second position due to a droop characteristic of the belt.

6. The apparatus of claim 2, wherein the friction belt is a rubber material.

7. The apparatus of claim 2, wherein first pulley is rotatably supported on a driving axis and the second pulley is rotatably supported by a belt pulley supporting axis.

8. The apparatus of claim 7, wherein the driving axis and the second belt pulley supporting axis are supported at a support of the lower part and of the frame in the paper feeding direction.

9. The apparatus of claim 2, wherein the friction part includes a driving axle coaxially connecting the driving gear and one of the first and the second belt pulleys.

10. The apparatus claim 9, further comprising at least one paper separating plate fixedly disposed at the angle at the lower part in the paper feeding direction which separates and feeds the sheets of paper one at a time while supporting the leading ends of the sheets stacked in the frame so that the sheets enter at the paper-entering angle in association with the friction part, when the sheets of paper are picked up by the pickup roller.

11. The apparatus of claim 2, further comprising a paper separating assembly having plural paper separating plates inclined at an angle at an inclined surface of the lower part and in the paper feeding direction of the frame.

12. The apparatus of claim 2, wherein the angle is about the same as the paper-entering angle.

13. The apparatus of claim 2, wherein the active paper separator includes:

a friction part rotatably disposed at the lower part in the paper feeding direction so that at least one tangent line thereof intersects the leading ends of the sheets, in order to separate and feed the sheets one at a time; and a driving part which rotates the friction part in association with a driving source which drives the paper feed unit.

14. The apparatus of claim 13, wherein the friction part includes a roller assembly having at least one rotating roller and, when the roller assembly includes more than one rotating roller, the rotating rollers share a common tangent line inclined at an angle and which intersects the leading ends of the sheets.

15. The apparatus of claim 14, wherein the at least one rotating roller is formed to slightly swing regularly or irregularly within a range beyond paper separating plates of a paper separating assembly so as to yield a frictional force to the leading ends of the sheets picked up by the pickup roller.

16. The apparatus of claim 15, wherein the at least one roller has fine projections formed on a surface thereof.

17. The apparatus of claim 14, wherein the at least one roller is five rollers.

18. The apparatus of claim 14, wherein the at least one rotating roller is a rubber material.

19. The apparatus of claim 14, wherein the driving part includes a driving axle coaxially connecting the driving gear and the rotating roller.

20. The apparatus of claim 19, further comprising at least one paper separating plate fixedly disposed at the angle at the lower part in the paper feeding direction which separates and feeds the sheets of paper one at a time while supporting the leading ends of the sheets stacked in the frame so that the sheets enter at the paper-entering angle in association with the friction part, when the sheets of paper are picked up by the pickup roller.

21. The apparatus of claim 13, wherein the friction part includes a plurality of rotating rollers rotatably disposed and having a common tangent line inclined at an angle so as to intersect the leading ends of the sheets, and a plurality of rotating roller angle so as to intersect the leading ends of the sheets, and a plurality of rotating roller supporting axles respectively supporting the plurality of rotating rollers, wherein the driving part includes a driving axle one of forming the plurality of rotating roller supporting axles and coaxially connecting the driving gear and one of the plurality of the rotating rollers, a plurality of rotating roller gears coaxially formed on the respective rotating roller supporting axles, and a plurality of idle gears disposed between the rotating roller gears.

22. The apparatus of claim 21, further comprising at least one paper separating plate fixedly disposed at the angle at the lower part in the paper feeding direction which separates and feeds the sheets of paper one at a time while supporting the leading ends of the sheets stacked in the frame so that the sheets enter at the paper-entering angle in association with the friction part, when the sheets of paper are picked up by the pickup roller.

23. The apparatus of claim 13, further comprising a paper separating assembly having plural paper separating plates inclined at an angle at an inclined surface of the lower part and in the paper feeding direction of the frame.

24. An image forming apparatus comprising:

an image former; and a paper feeder having a frame forming one of a paper stacker and a paper feed tray on which paper is stackable, a paper feed unit disposed above the frame and including a pickup roller which picks up paper, and an active paper separator disposed at a lower part of the frame in the paper feeding direction thereof, contacting leading ends of sheets disposed in the frame, at a certain angle, rotatable in an anti-paper feeding direction opposite the feeding direction so as to actively rub the leading ends and thereby separate and feed the sheets one at a time when the sheets of paper are picked up by the pickup roller, wherein the active pacer separator includes a driving part driven by a driving source which drives the paper feed unit and includes a driving gear disposed so that at least a part thereof projects one of outwardly and upwardly from the lower part.

* * * * *

UNITED STATES PATENT AND TRADEMARK OFFICE

CERTIFICATE OF CORRECTION

PATENT NO. : 7,097,171 B2
APPLICATION NO. : 10/750895
DATED : August 29, 2006
INVENTOR(S) : Hoon Kang It is certified that error appears in the above-identified patent and that said Letters Patent is hereby corrected as shown below:

Column 10, Line 54, change “are spaced by a distance” to --have widths--.

Column 10, Line 54, change “length” to --width--.

Column 11, Line 1, change “friction” to --driving--.

Column 11, Line 18, change “claim 2,” to --claim 1,--.

Column 12, Line 44, change “pacer” to --paper--.

Signed and Sealed this

Thirtieth Day of January, 2007

JON W. DUDAS
*Director of the United States Patent and Trademark Office*